US008974219B2

(12) United States Patent
Couch

(10) Patent No.: US 8,974,219 B2
(45) Date of Patent: Mar. 10, 2015

(54) CEMENTITIOUS SURFACE FINISHING TOOL SYSTEM

(71) Applicant: Mark Wayne Couch, Mineda, TX (US)

(72) Inventor: Mark Wayne Couch, Mineda, TX (US)

( * ) Notice: Subject to any disclaimer, the term of this patent is extended or adjusted under 35 U.S.C. 154(b) by 0 days.

(21) Appl. No.: 13/950,058

(22) Filed: Jul. 24, 2013

(65) Prior Publication Data

US 2015/0026907 A1 Jan. 29, 2015

(51) Int. Cl.
*E01C 19/12* (2006.01)

(52) U.S. Cl.
CPC ..... *E01C 19/12* (2013.01)
USPC ..... 425/458; 404/118; 15/235.3; 15/105.5; 264/33; 264/333; 264/334; 425/84; 425/215; 425/318; 425/375; 425/385; 425/469; 425/470

(58) Field of Classification Search
USPC ..... 425/87, 215, 318, 375, 385, 458, 469, 425/470; 264/33, 333–334; 15/235.3, 15/105.5; 404/118
See application file for complete search history.

(56) References Cited

U.S. PATENT DOCUMENTS

| | | | | |
|---|---|---|---|---|
| 4,358,123 | A * | 11/1982 | Richards | 280/47.131 |
| 4,571,170 | A * | 2/1986 | Tackett et al. | 425/458 |
| 4,861,188 | A * | 8/1989 | Rouillard | 404/75 |
| 4,915,610 | A * | 4/1990 | Curry | 425/458 |
| 5,609,437 | A * | 3/1997 | Silva | 404/118 |
| 6,089,787 | A * | 7/2000 | Allen et al. | 404/118 |
| 6,139,217 | A * | 10/2000 | Reuter | 404/97 |
| 6,231,331 | B1 * | 5/2001 | Lievers | 425/183 |
| 6,923,630 | B2 * | 8/2005 | Allen | 425/63 |
| 7,010,828 | B1 * | 3/2006 | Flores et al. | 15/235.3 |
| 7,470,084 | B2 * | 12/2008 | Brotzel | 404/118 |
| 8,016,045 | B2 * | 9/2011 | Milthorpe | 172/817 |
| 8,100,447 | B2 * | 1/2012 | DeWinter | 294/51 |
| 2003/0143025 | A1 * | 7/2003 | Catania | 404/118 |
| 2006/0257207 | A1 * | 11/2006 | Face et al. | 404/118 |
| 2007/0031191 | A1 * | 2/2007 | Quenzi et al. | 404/118 |
| 2007/0154260 | A1 * | 7/2007 | Lindley | 404/114 |
| 2007/0206991 | A1 * | 9/2007 | Brotzel | 404/118 |

FOREIGN PATENT DOCUMENTS

| | | | |
|---|---|---|---|
| GB | 2095310 A | * | 9/1982 |
| GB | 2157353 A | * | 10/1985 |

OTHER PUBLICATIONS

Translation of JP 2004137688.*
Translation of DE 4037981.*

* cited by examiner

*Primary Examiner* — Jacob Thomas Minskey
(74) *Attorney, Agent, or Firm* — James A. Italia; Italia IP

(57) ABSTRACT

A modular tool for imparting profile characteristics into fluent cementitious material. The tool has an elongated base forming a permanently fixed blade, and at least one handle. The blade is configured to act as a dovetail to which any of several modular blades may frictionally fit in removable fashion. The fixed blade forms a deflector disposed to deflect removed cementitious material away from the handles. Other blades may fit by peg and socket engagement. The tool may have detachable rollers enabling the tool to advance at a controlled elevation along a wall being formed and shaped. A slide block may be arranged to engage the rollers so as to adjust their position on the tool. The tool may have integral bubble levels.

17 Claims, 11 Drawing Sheets

CEMENTITIOUS SURFACE FINISHING TOOL SYSTEM

CROSS-REFERENCE TO RELATED APPLICATION

This Continuation Application claims priority to pending Non-Provisional U.S. application Ser. No. 13/167,397, filed on Jun. 23, 2011, incorporated herein by reference in its entirety and claims priority thereto.

FIELD OF THE INVENTION

The present invention relates to tools for finishing cementious surfaces, such as uncured cement, and more particularly, for imparting desired profile characteristics to uncured or partially cured cementitious surfaces.

BACKGROUND OF THE INVENTION

Swimming pools are typically formed from cementitious materials which are applied in a thick liquid state and allowed to cure or harden into a desired final configuration. Pools have both regular and somewhat irregular configurational features, such as curved and straight surfaces which must be formed to the desired shape or profile, and also make smooth transitions in various places from curved to straight or planar surfaces. The cementitious constituent material must usually be hand worked to achieve final desired surface configurations because of periodic variation in surface contours.

This is a challenging task. For one thing, vertical walls must be modified to include among other features, horizontal grooves, periodic recesses, and other shapes. Many of these features extend along a significant length if not the full length of the pool wall. Care must be taken to avoid waviness of horizontal lines and planes as these shapes are formed in the unfinished wall, to maintain constant or unvarying height of grooves and other features along their length, and to maintain depth of grooves as the grooves project into the wall, to name a few of the situations that confront the craftsman charged with finishing a swimming pool.

There exists a need for tools which are particularly suited for accomplishing these goals.

SUMMARY OF THE INVENTION

The present invention addresses the above needs by providing a modular tool or, referring to the base tool and its removable modules, a modular tool system which is particularly adapted to impart desired form to vertical and horizontal pool surfaces. The base or fundamental component is a structural frame having one or more handles, an elongated body for receiving blades and other shape imparting elements, rollers for supporting the base component from a suitable pool surface, and levels for enabling the user to maintain vertical and horizontal orientation of the tool.

It is an object of the invention to provide a modular tool that is adaptable to the various shapes which must be formed in soft cementitious materials.

Another object of the invention is to provide a module tool which is readily held at appropriate orientations and levels at various surfaces of a swimming pool.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
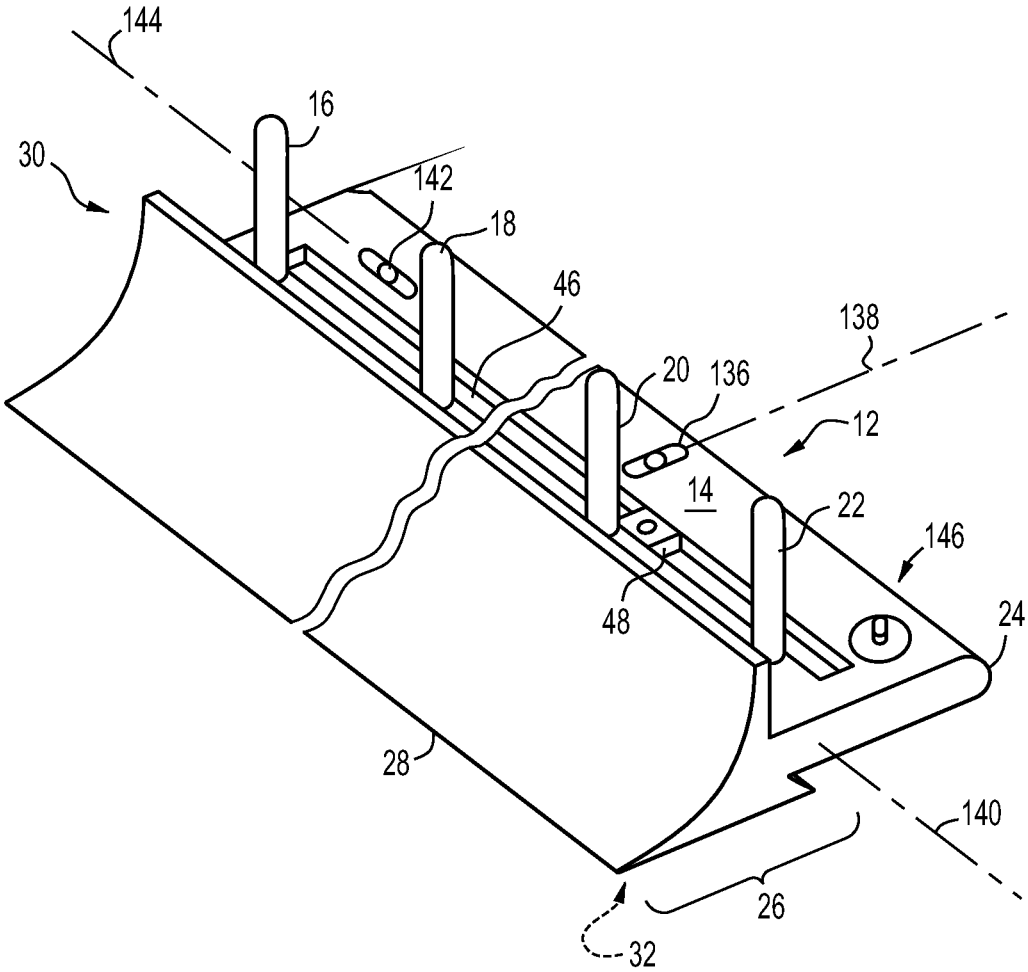
FIG. 1 is a perspective view of the base component of the novel tool system.

Referring first to FIG. 1, according to at least one aspect of the invention, there is shown an elongated base 12 for a modular tool system 10 (not shown in its entirety in FIG. 1) for imparting profile characteristics or otherwise forming surfaces of uncured or partially cured cementitious materials used to fabricate walls and other surfaces of swimming pools (not shown) for example. Of course, swimming pools are only one example of objects which may be constructed from cementious materials. Cementitious materials may include cement, concrete, plaster, mortar, grout, and similar substances which are typically prepared from granulated raw materials, mixed with water, and which assume a thick, fluid condition, and which ultimately cure or harden into a hard, inflexible solid. The modular tool system 10 is intended to impart surface features into walls and other surfaces when the cementitious material is sufficiently fluid to flow responsive to application of a trowel or like tool (not shown), yet sufficiently viscous or solid so as to hold its form after being shaped with a trowel or like tool.

The base 12 may comprise an elongated platform 14 which bears a plurality of handles 16, 18, 20, 22 projecting therefrom. The handles 16, 18, 20, 22 may be regarded as principals handles, which are spaced apart from one another, which may be parallel to one another, and which are arranged to occupy a plane which extends along the length of the platform 14. In addition to the principal handles 16, 18, 20, 22, that side 24 of the platform 14 which is opposed to a permanent blade 26 which is permanently fixed to the platform 14 may be rounded, as seen in end view. The side 24 of the platform 14 may serve as an auxiliary handle due to comfort afforded to grip of the platform 14 at the rounded side 24, to overall thickness of the platform 14, and other configurational and dimensional characteristics of the side 24. It will be seen that the principal handles 16, 18, 20, 22 are oriented to present a hand gripping position which is at a generally right angle to the hand gripping position presented by the auxiliary handle established by the rounded side 24.

The platform 14 and the permanent blade 26 are shown as integral and could be fabricated integrally, but of course could also be fabricated as two components which are subsequently fixed to one another. For this reason, the terms base 12 and platform 14 may be employed interchangeably herein. It will be seen that the platform 14 and permanent blade 26 collectively form a dovetail for engaging other components of the modular tool 10, as will be explained hereinafter. The permanent blade 26 has not only a working edge 28 which could be utilized to scrape a large surface, but also curvature culminating in a surface 30 which projects generally at a perpendicular angle to that portion of the permanent blade 26 which is proximate the working edge 28. The surface 30 serves as a deflector which is disposed to deflect cementitious material waste which as been scraped by the permanent blade 26 from the fluent cementitious material away from the principal handles 16, 18, 20, 22. It will be appreciated that the underside surface 32 of the permanent blade 26 could be utilized for smoothing cementitious surfaces being worked.

Figure 2:
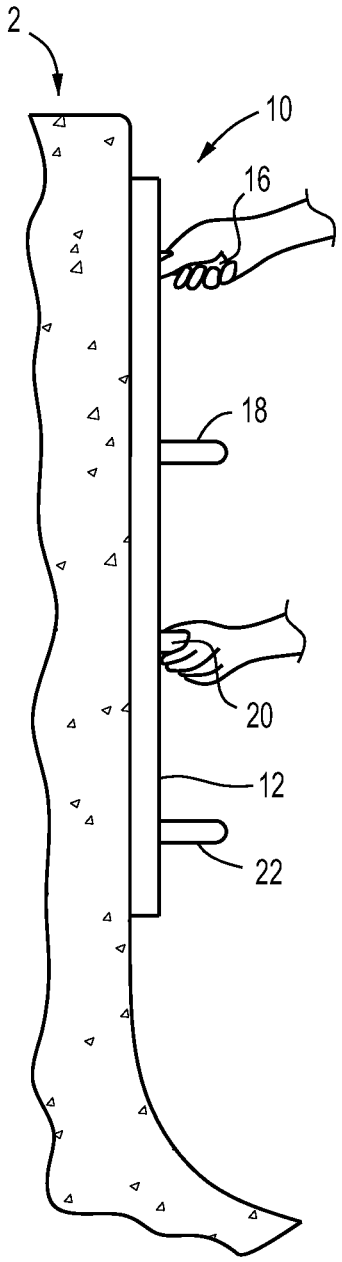
FIG. 2 is an environmental side view of the novel tool in use, and is shown partly in cross section.

FIG. 2 shows an exemplary cementitious wall 2 being worked by the modular tool 10. The modular tool 10 is shown being grasped by two principal handles 16, 20 and held in a vertical orientation. In this orientation, the modular tool 10 may be moved horizontally along the wall 2, for smoothing, final scraping, or similar operations.

It should be noted at this point that orientational terms such as horizontal, vertical refer to the subject drawing as viewed by an observer. The drawing figures depict their subject matter in orientations of normal use, which could obviously change with changes in the way the novel modular tool 10 is grasped. Therefore, orientational terms must be understood to provide semantic basis for purposes of description, and do not limit the invention or its component parts in any particular way.

Figure 3:
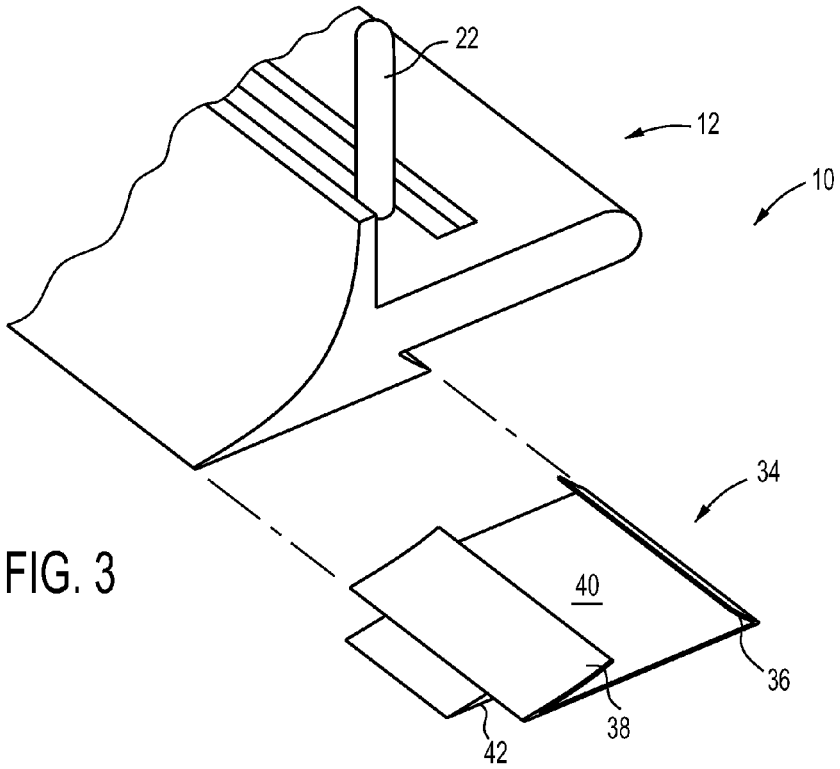
FIG. 3 is an exploded detail view of the base component of FIG. 1, shown together with a modular blade.

FIG. 3 shows a first removable blade 34 which is removably engageable with the dovetail of the permanent blade 26. The first removable blade 34 has opposed canted walls 36, 38 joined to a central panel 40 which collectively form a socket which envelops and is retained on the dovetail. A blade member 42 projects from the joint of the canted wall 38 and the central panel 40.

Figure 4:
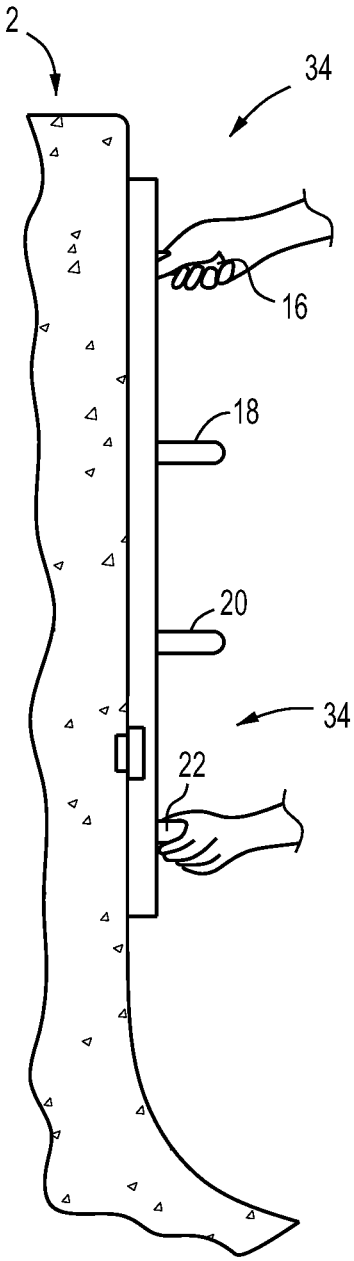
FIG. 4 is an environmental side view of the novel tool in use with a modular blade attached, and is shown partly in cross section.
Figure 5:
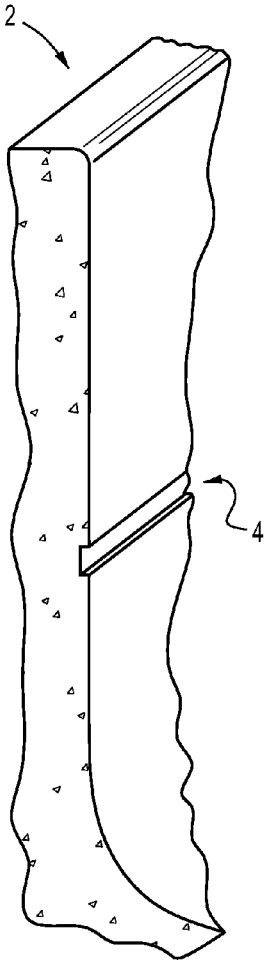
FIG. 5 is an environmental side view of a groove which may be formed in a wall by the novel modular tool.

FIG. 4 shows the first removable blade 34 in use. The modular tool 10 is depicted as being grasped by the principal handles 16, 22, and in use would be moved horizontally. The blade member 42 projects into the fluent cementitious material of the wall 2. Referring to FIG. 5, this will result in a groove 4 being formed in the wall 2.

Figure 7:
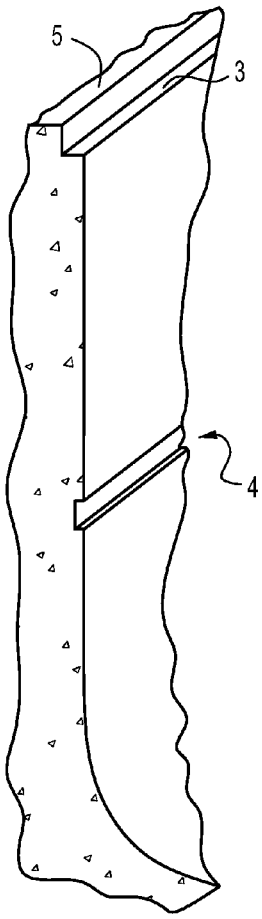
FIG. 7 is an environmental side view of a groove and a top step which may be formed in a wall by the novel modular tool.
Figure 6:
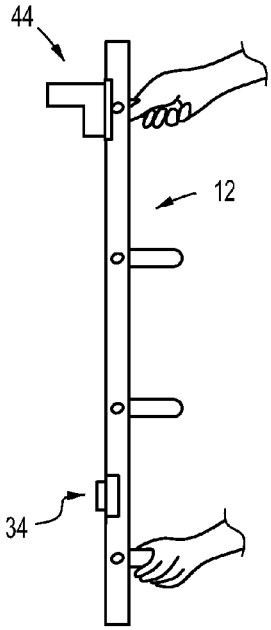
FIG. 6 is a side view of the novel modular tool, shown with several optional modular working elements assembled to the base component.

FIG. 6 shows the first removable blade 34 and also a removable step forming blade 44 attached to the base 12 for simultaneously forming two features in a wall such as the wall 2. These features include the groove 4 and also steps defined by a shoulder 3 and the upper flat surface 5 shown in FIG. 7. The step forming blade 44 has a stepped configuration for forming steps, such as that formed by the shoulder 3 and the upper flat surface 5. The step forming blade 44 will be understood to include a connector for removably engaging the dovetail of the platform 14 and the permanent blade 26. Although details are not visible in FIG. 7, the connector may comprise an arrangement similar in structure and function to the socket arrangement of the first removable blade 34, for example.

Frictional retention on the dovetail is not the only way to mount modular blades and other working tools to the base 12. Returning to FIG. 1, the base 12 is seen to have a groove 46 extending along at least part of the length of the base 12. A slide block 48 may be slidably mounted within the groove 46 and entrapped therein. The slide block or block 48 may comprise a connector for receiving and removably retaining accessory devices which may be temporarily attached to the base 12. As depicted, the connector may comprise a hole 50 which receives a corresponding peg (not shown) of an accessory device, and retains the peg by friction. Other types of connectors (not shown) may of course also be employed.

Figure 8:
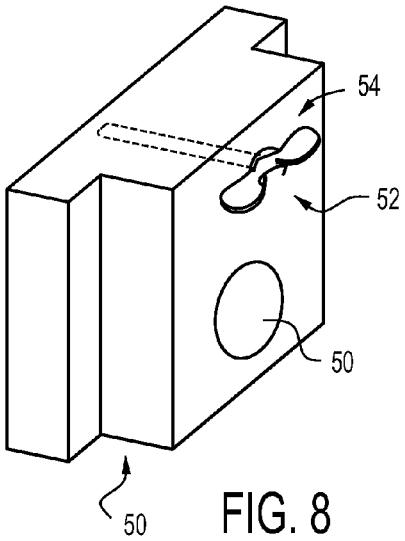
FIG. 8 is an enlarged detail view of a mobile component seen towards the center of FIG. 1.

The block 48 may be configured as shown in FIG. 8, having an enlarged base member 52. The groove 46 may be a T-slot or tee shaped groove which cooperatively receives the block 48 and retains the block 48 by interference while still permitting sliding of the block 48 along the groove 46. The block 48 may comprise a lock such as a setscrew 52 having a winged head 54 which may be grasped and rotated to tighten and untighten the threads of the setscrew 52. Tightening of the setscrew 52 may lock the block 48 in place by engaging a surface of the base 12 for example, thereby providing a lock which is disposed to releasably hold the block 48 at a selected position along the groove 46.

Figure 9:
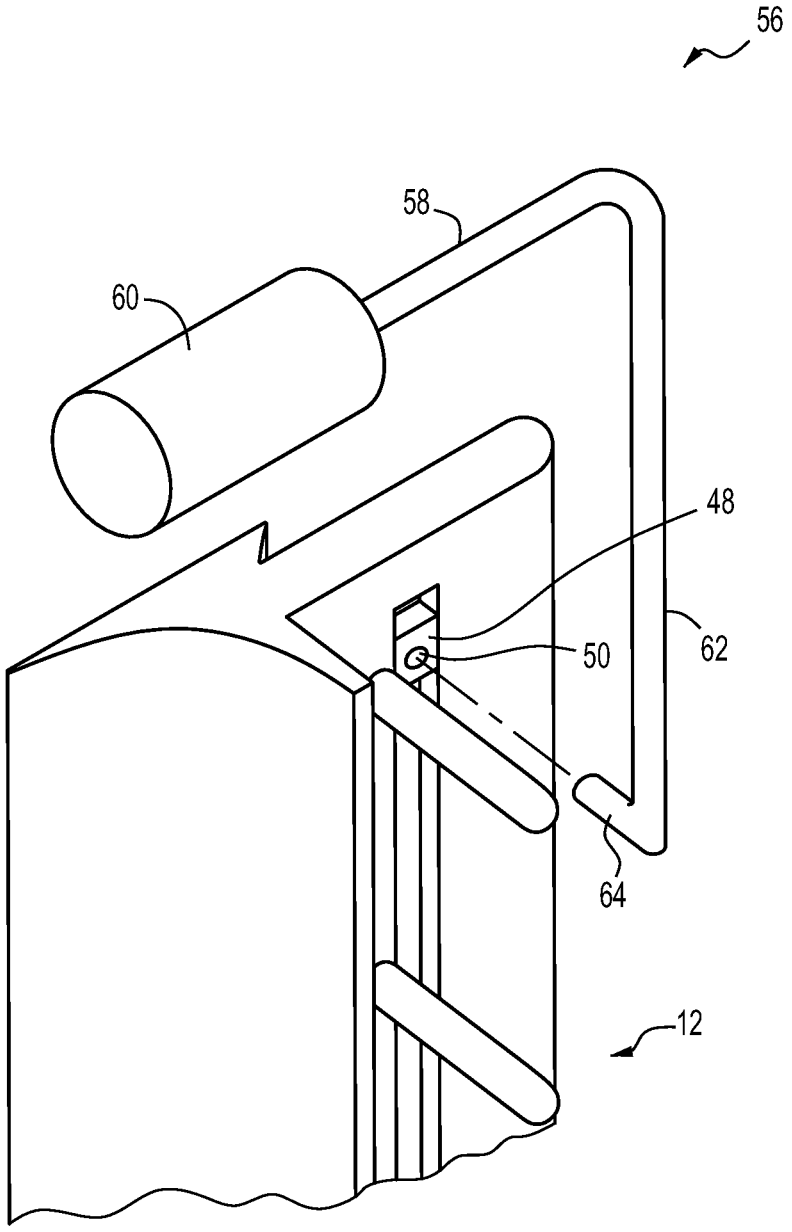
FIG. 9 is an exploded perspective view of the base component shown in FIG. 1, with a modular roller device.

FIG. 9 illustrates an accessory device which is usable with the modular tool 10. In this example, the accessory device is a roller arrangement 56 including a rod 58 serving as an axle, a roller 60 rotatably mounted on the axle, and a first extension section 62 of the axle 58. The extension section 62 terminates in a peg section 64 which is dimensioned and configured to connect to the block 48 by engaging the hole 50 by friction. The roller arrangement enables the tool to be guided when being moved horizontally as depicted in FIGS. 2, 4, and 6. That is, with the roller 60 resting on the upper surface of the wall 2, the modular tool 10 is supported by the roller arrangement to move at an unvarying elevation relative to the wall 2. Hence the user is free to concentrate only minimally on controlling elevation of the modular tool 10 and hence to focus on forming the features of the wall 2 which are shaped by the various blades and working surfaces of the modular tool 10.

Figure 10:
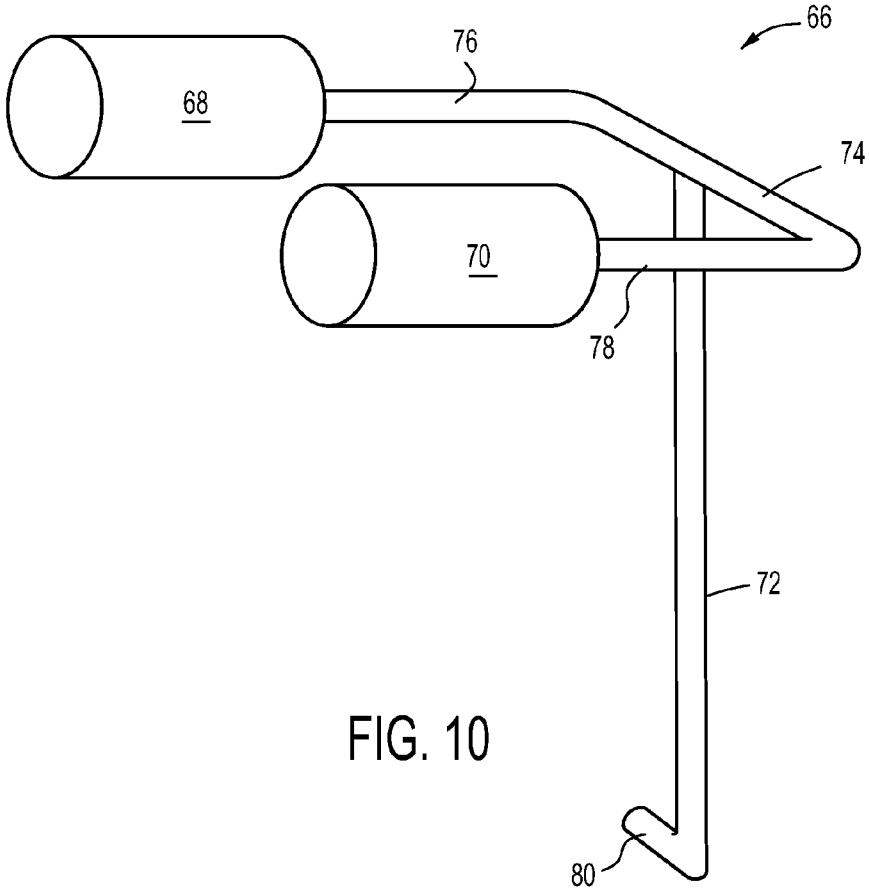
FIG. 10 is shows a second modular roller device which is usable with the base component shown in FIG. 1.
Figure 13:
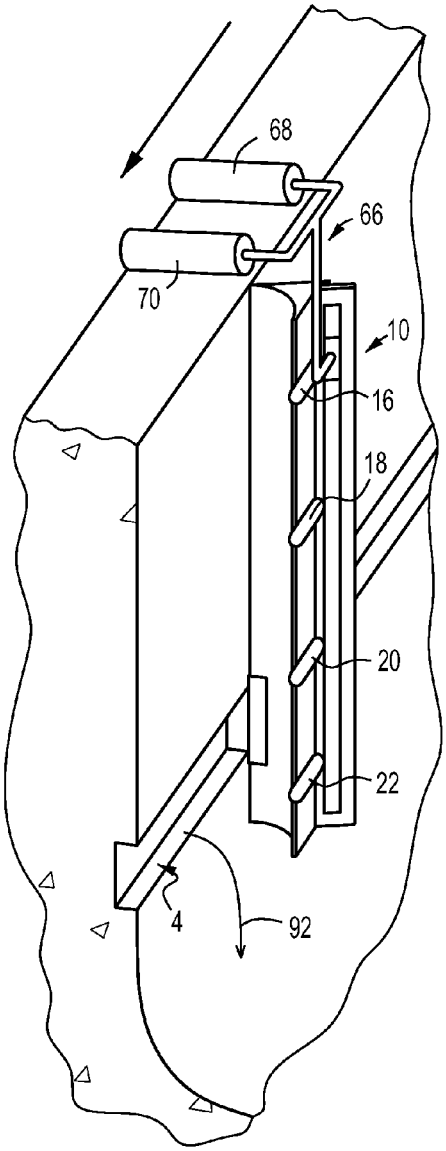
FIG. 13 is an environmental perspective view of the novel modular tool in use.

FIG. 10 shows a variation on the roller arrangement of FIG. 9. In FIG. 10, a rod 66 supports two rollers 68, 70, and additional rollers (not shown) if desired, in tandem. The tandem arrangement enables the two rollers 68, 70 to roll simultaneously along the same flat surface in a common plane, thereby opposing any tendency of the modular tool 10 to swing or tilt as it is moved horizontally along the wall 2. The rod 66 may comprise a stem 72 which is a counterpart of the extension section 62, a cross piece 74 fixed to the stem 72, a first axle 76 which rotatably supports the roller 68 and a second axle 78 which rotatably supports the roller 70, and a peg section 80 which may be the structural and functional equivalent of the peg section 64 of FIG. 9. FIG. 13 shows the roller arrangement of FIG. 10 in use, attached to the modular tool 10.

FIG. 13 also illustrates deflection of removed cementitious material (not shown). Any cementitious material which is scraped from the wall 2, such as that which must be removed in order to form the groove 4, will be intercepted and redirected downwardly as depicted by an arrow 92 in FIG. 13 away from the principal handles 16, 18, 20, 22 before the user's hands become fouled by contact with such removed cementitious material.

Figure 12:
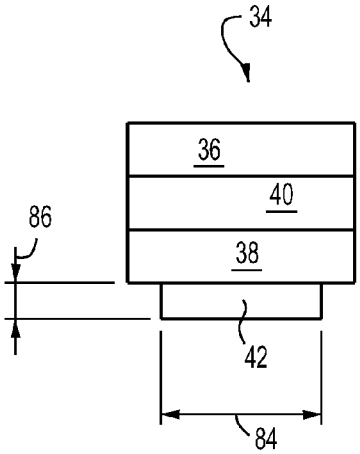
FIG. 12 is a plan view of the modular blade shown at the bottom right of FIG. 3.
Figure 11:
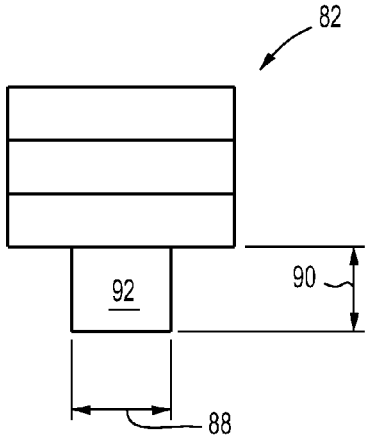
FIG. 11 is a plan view of a modular blade which is usable with the base component of FIG. 1.

Working elements of the modular tool 10 such as the permanent blade 26 and the removable blade 34 may be supplemented by other working elements. Illustratively, and referring to FIG. 11, additional modular working elements may include a second removable blade 82. The second removable blade 82 may be generally similar in purpose and method of operation as the first removable blade 34, apart from dimensions of the respective blade sections. The second removable blade 82 may have socket structure which slidably surrounds and engages the dovetail of the base 12 in a manner like that of the first removable blade 34. However, the second removable blade 82 has a configuration which is different from that of the first removable blade 34. As seen by comparing FIGS. 11 and 12, the blade member 42 may have a width (indicated by an arrow 84) and a depth (indicated by an arrow 86) which differ from corresponding width (indicated by an arrow 88) and depth (indicated by an arrow 90) of the blade member 92 of the second removable blade 82.

Figure 14:
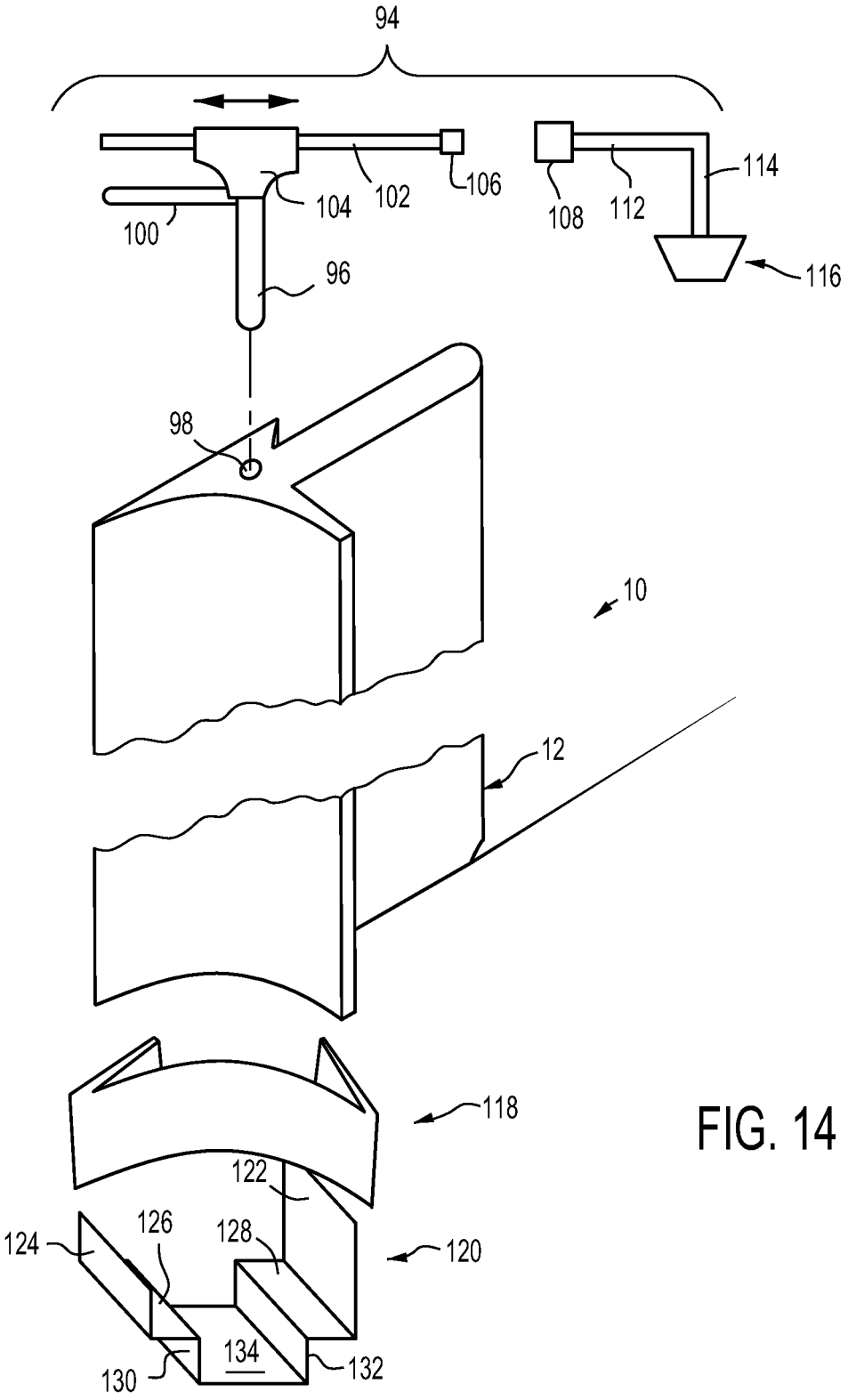
FIG. 14 is an exploded perspective view of the modular tool showing two additional modular working elements which may be removably attached to the base component.

FIG. 14 shows two additional modular working elements of the modular tool 10. A groove cutting module 94 may be removably attached to the base 12 by a peg 96 adapted to be received and retained by friction within a hole 98. The groove cutting module 94 may have a handle 100, and an attachment arm comprising an adjustably positioned rod 102 both mounted to an enlargement 104. The rod 102 may terminate in a connector or fitting 106 which is received in a socket 108 located at the proximal end of a blade holding rod 110. The blade holding rod 110 may have a first leg 112 which projects laterally from the rod 102, and at its distal end, a second leg 114 disposed at a perpendicular angle to the first leg 112 so as to face downwardly as depicted in FIG. 14. A blade member 116 may be fixed to the distal end of the second leg 114 such that the blade member 116is arranged to project downwardly when the modular tool 10 is held in a vertical orientation, such as the orientation of FIGS. 2 and 4. It follows that with the groove cutting module 94 assembled, when the modular tool 10 is positioned as shown in FIG. 4, the groove cutting module 94 will generate a groove (not shown) which would be parallel to the step which includes the shoulder 3 shown in FIG. 7, but which projects downwardly into the upwardly facing surface of the wall 2.

Another working element shown in FIG. 14 is a removable trough cutting module 118 having a trough cutting blade 120 and a connector which is removably engageable with the base 12 of the modular tool 10. The connector may comprise an arrangement similar in structure and function to the socket arrangement of the first removable blade 34, for example. The trough cutting blade 120 may have opposed parallel upper panels 122, 124, opposed aligned horizontal panels 126, 128, opposed parallel lower panels 130, 132, and a bottom panel 134 which spans the opposed parallel lower panels 130, 132.

Figure 15:
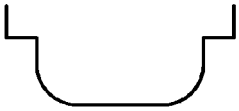
FIG. 15 is an end view of an optional working element usable with the base component.
Figure 16:
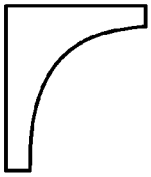
FIG. 16 is an end view of another optional working element usable with the base component.
Figure 17:
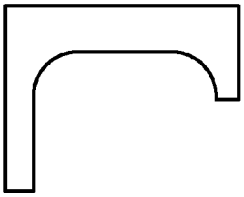
FIG. 17 is an end view of still another optional working element usable with the base component.

Additional working elements may be provided for use with the modular tool 10. These additional working elements may have not only straight cutting elements arranged at perpendicular angles to one another, as has characterized those working elements described thus far, but rather may have cutting surfaces arranged to form curved profiles and shapes, and may if desired depart from perpendicularity. FIGS. 15, 16, and 17 illustrate some curved cutting elements that may be incorporated into working elements which in other ways correspond to the first and second removable removable blades 34, 82, or the groove cutting module 94.

Referring again to FIG. 1, the modular tool 10 may comprise a first bubble level 136 which is oriented to have a longitudinal working axis (seen as a projection line 138) disposed perpendicularly to the longitudinal axis 140 of the platform 14 of the modular tool 10. A second bubble level 142 which is oriented to have a longitudinal working axis 144 disposed parallel to the longitudinal axis 140 of the platform 14 may be provided. A third bubble level 146 which is angularly adjustable relative to the platform 14 of the modular tool 10 may be provided.

Figure 18:
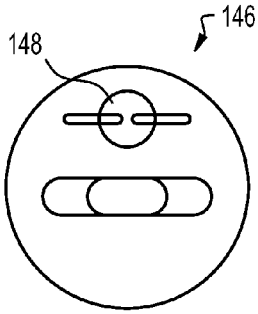
FIG. 18 is an enlarged plan detail view of a bubble level seen at the lower right of FIG. 1.

Turning now to FIG. 18, the third bubble level 146 may comprise a lock which is disposed to releasably hold the third bubble level 146 in a selected angular orientation on the platform 14 of the modular tool 10. The lock may take the form of a setscrew 148 which is a structural and functional counterpart of the setscrew 54 of the block 48.

Figure 19:
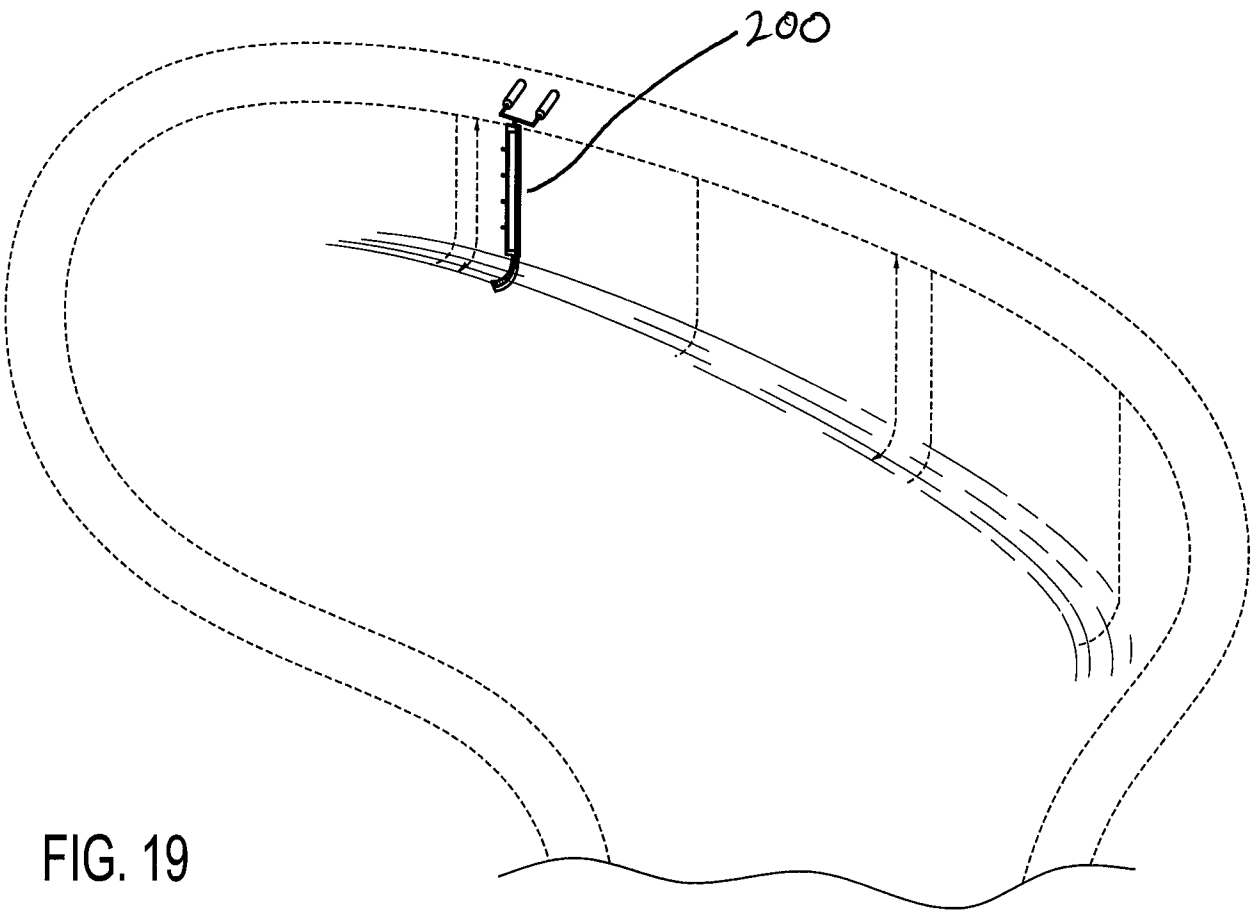
FIG. 19 is another embodiment of the modular tool with an adjustable platform.

Referring to FIG. 19, the modular tool 10, may have a platform 14 that is adjustable in length 200. As an non-limiting example, the platform 14 may be adjustable in length 200 by using a telescopic method wherein the desired length would be locked into place. As such, the modular tool 10 may be customizable for a particular job.

Figure 20:
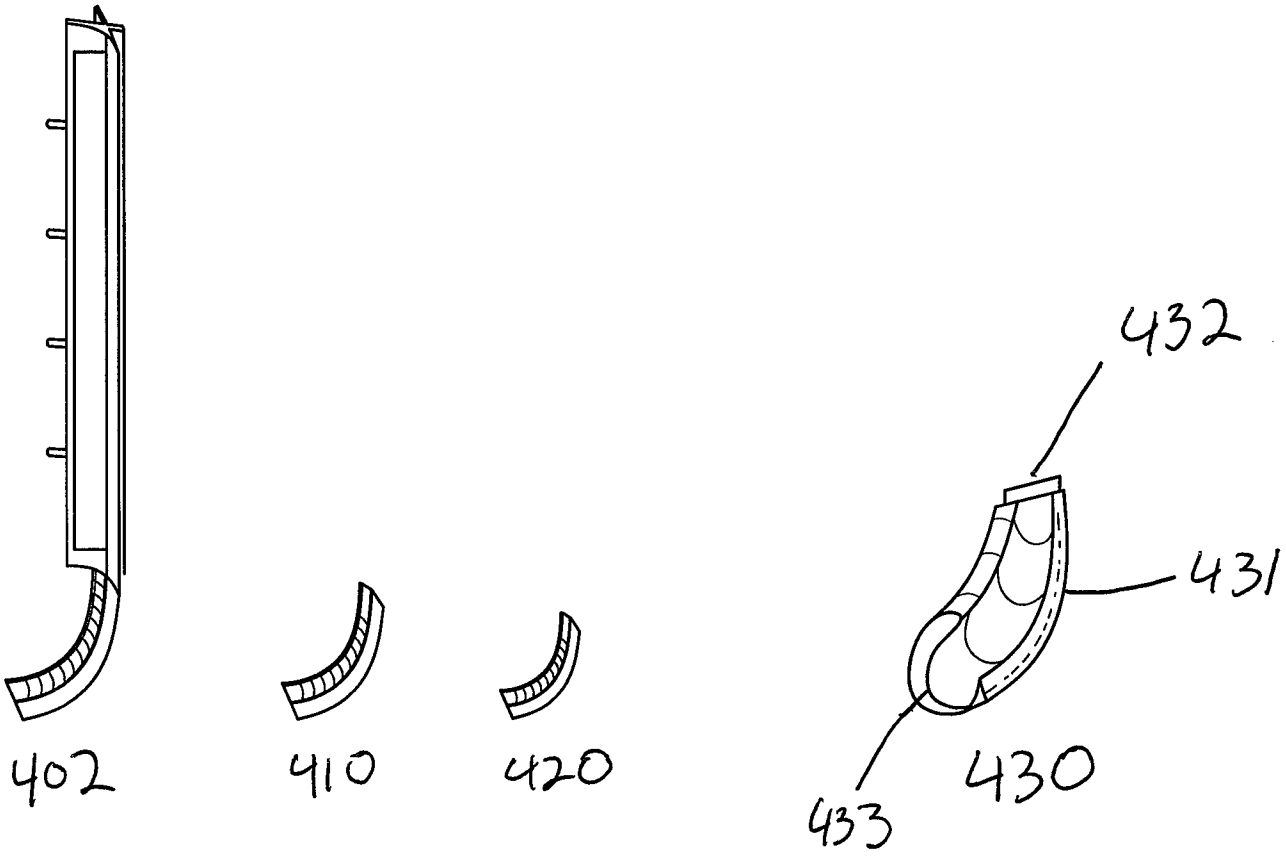
FIG. 20 is alternate views of the cutting devices usable with the adjustable platform.

Referring to FIG. 20, the modular tool 10, may have different crescent shaped cutting devices for cutting different radii. The tool 10 shows a crescent shaped cutting device 402 attached. As a non-limiting example, each crescent shaped device eight inch 410 and six inch 420 has a different radius and would accordingly shape the cement in different radii. A close up of the cutting device 430 is seen. The The cutting edge 431 comes in contact with the cement to give it the desired look. The attachment region 432 is connected to the modular tool 10. When the cement is being shaped, the excess cement would be removed via the collection trough 433 and expended.

Figure 21:
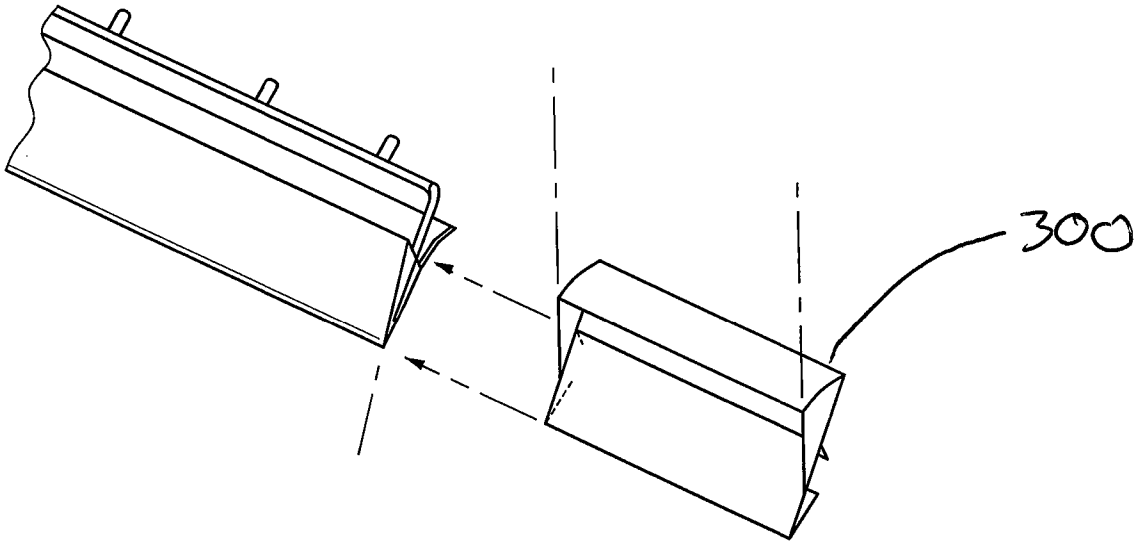
FIG. 21 is a plan view of the slip-on cutting plate connector.

Referring to FIG. 21, the modular tool 10, may have a slip-on cutting plate connector 300 which is removably engageable with the platform 14. The slip-on cutting plate connector 300 comes in different lengths and different cutting depths. The slip-on cutting plate connector 300 would slide on to the platform 14 and would attach. As a non-limiting example, it may attach by the use of latches that are held in place by a rod.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A modular tool for imparting profile characteristics into fluent cementitious material, comprising:

an elongated base having a platform and a permanent blade fixed to the platform, which said platform and permanent blade collectively form a dovetail for engaging other components of the modular tool projecting from the platform, and at least one principal handle projecting from the platform;

a deflector disposed to deflect cementitious material waste which has been scraped by the permanent blade from the fluent cementitious material away from the at least one principal handle wherein the deflector is at the proximate end of said permanent blade;

at least a first removable blade which is engageable with the dovetail of the platform and the permanent blade, wherein the first removable blade has opposed canted walls joined to a central panel which collectively form a socket which envelops and is retained on the dovetail;

an accessory device usable with the modular tool; and a groove extending along at least part of the length of the elongated base, and a block slidably mounted within the groove, wherein the block comprises a connector for receiving and removably retaining the accessory device, wherein said accessory device slides on the permanent blade thereby changing the blade profile.

2. The modular tool of claim 1, further comprising a lock disposed to releasably hold the block at a selected position along the groove.

3. The modular tool of claim 1, wherein the accessory device comprises a roller arrangement further comprising a roller mounted on an axle, and wherein the axle is dimensioned and configured to connect to the block of the elongated base.

4. The modular tool of claim 3, wherein the roller arrangement comprises at least two rollers arranged in tandem so as to be able to roll along the same flat surface.

5. The modular tool of claim 1, further comprising a second removable blade which is mountable to the modular tool by slidably surrounding and engaging the dovetail of the platform and the permanent blade, which said second removable blade has a configuration which is different from that of the first removable blade, wherein the second removable blade has opposed canted walls joined to a central panel which collectively form a socket which envelops and is retained on the dovetail.

6. The modular tool of claim 1, further comprising a removable step forming blade having a stepped configuration and a connector for removably engaging the dovetail of the platform and the permanent blade, wherein the step forming blade has opposed canted walls joined to a central panel which collectively form a socket which envelops and is retained on the dovetail.

7. The modular tool of claim 1, further comprising a removable groove cutting module for forming a groove in an upwardly facing surface of the fluent cementitious material, wherein the groove cutting module is attached to the tool by a peg, comprising an attachment arm comprising a first leg bearing a connector formed at one end of the first leg of the attachment arm, a second leg disposed at a perpendicular angle to the first leg, the second leg having a proximal end joined to the first leg, a distal end, and a cutting blade fixed to the distal end of the second leg and arranged to project downwardly when the modular tool is held in a vertical orientation.

8. The modular tool of claim 1, further comprising a removable trough cutting module having a trough cutting blade and a connector which is removably engageable with the platform of the modular tool, wherein the trough cutting module has opposed canted walls joined to a central panel which collectively form a socket which envelops and is retained on the platform.

9. The modular tool of claim 1, further comprising a first bubble level oriented to have a longitudinal working axis disposed perpendicularly to said longitudinal axis of the platform of the modular tool.

10. The modular tool of claim 1, further comprising a second bubble level oriented to have a longitudinal working axis disposed parallel to said longitudinal axis of the platform of the modular tool.

11. The modular tool of claim 1, further comprising a third bubble level which is angularly adjustable relative to the platform of the modular tool, and a lock disposed to releasably hold the third bubble level in a selected angular orientation on the platform of the modular tool, wherein said lock comprises of a setscrew.

12. The modular tool of claim 1, wherein the at least one principal handle comprises at least two principal handles each of which projects from the platform.

13. The modular tool of claim 12, wherein the at least two principal handles occupy a plane which extends along the length of the platform.

14. The modular tool of claim 13, wherein one side of the platform which is opposed to the permanent blade is rounded in end view, and is dimensioned and configured to serve as an auxiliary handle, and wherein the at least two principal handles are oriented to present a hand gripping position which is at a generally right angle to the hand gripping position presented by the auxiliary handle.

15. The modular tool of claim 1, further comprising a slip-on cutting plate connector which is removably engageable with the platform of the modular tool.

16. The modular tool of claim 1, further comprising a platform that is adjustable in length.

17. The modular tool of claim 1, further comprising a crescent shaped cutting device for cutting a radius.

* * * * *